US006187065B1

(12) United States Patent
Jackson

(10) Patent No.: US 6,187,065 B1
(45) Date of Patent: Feb. 13, 2001

(54) ADDITIVES AND OIL COMPOSITIONS

(75) Inventor: Graham Jackson, Berkshire (GB)

(73) Assignee: Exxon Chemical Patents Inc, Linden, NJ (US)

( * ) Notice: Under 35 U.S.C. 154(b), the term of this patent shall be extended for 0 days.

(21) Appl. No.: 09/203,691

(22) Filed: Dec. 2, 1998

(30) Foreign Application Priority Data

Dec. 3, 1997 (GB) ..... 9725581

(51) Int. Cl.[7] ..... C10L 1/18
(52) U.S. Cl. ..... 44/393; 585/9
(58) Field of Search ..... 44/393; 585/9

(56) References Cited

U.S. PATENT DOCUMENTS

| | | | | |
|---|---|---|---|---|
| 272,889 | | 2/1883 | Lafferty . | |
| 2,177,732 | * | 10/1939 | MacLaren | 585/9 |
| 2,917,375 | * | 12/1959 | Hudson | 585/9 |
| 3,245,766 | * | 4/1966 | Lifson et al. | 585/9 |
| 3,250,599 | * | 5/1966 | Kirk et al. | 585/9 |
| 3,288,577 | * | 11/1966 | Patinkin et al. | 585/9 |
| 3,445,205 | * | 5/1969 | Patinkin et al. | 585/9 |
| 3,620,696 | * | 11/1971 | Hollyday, Jr. | 585/9 |
| 3,660,058 | | 5/1972 | Feldman et al. . | |
| 3,733,184 | * | 5/1973 | Zimmerman et al. | 44/593 |
| 3,846,093 | | 11/1974 | Feldman . | |
| 3,955,940 | | 5/1976 | Hollyday, Jr. . | |
| 3,961,916 | | 6/1976 | Ilnyckyj et al. . | |
| 4,147,520 | | 4/1979 | Ilnyckyj . | |
| 4,210,424 | * | 7/1980 | Feldman et al. | 585/9 |
| 4,211,534 | | 7/1980 | Feldman . | |
| 4,491,455 | | 1/1985 | Ishizaki et al. . | |
| 4,631,071 | | 12/1986 | Axelrod et al. . | |
| 4,639,255 | * | 1/1987 | Schuettenberg et al. | 585/9 |
| 4,639,256 | | 1/1987 | Axelrod et al. . | |

FOREIGN PATENT DOCUMENTS

| | | |
|---|---|---|
| 0 061 895 | 10/1982 | (EP) . |
| 0 113 581 | 7/1984 | (EP) . |
| 0 117 108 | 8/1984 | (EP) . |
| 0 153 176 | 8/1985 | (EP) . |
| 0 153 177 | 8/1985 | (EP) . |
| 0 156 577 | 10/1985 | (EP) . |
| 0 213 879 | 3/1987 | (EP) . |
| 0 214 786 | 3/1987 | (EP) . |
| 0 225 688 | 6/1987 | (EP) . |
| 0 239 320 | 9/1987 | (EP) . |
| 0 261 957 | 3/1988 | (EP) . |
| 0 282 342 | 9/1988 | (EP) . |
| 0 283 292 | 9/1988 | (EP) . |
| 0 316 108 | 5/1989 | (EP) . |
| 0 326 356 | 8/1989 | (EP) . |
| 0 343 981 | 11/1989 | (EP) . |
| 0 356 256 | 2/1990 | (EP) . |
| 1263152 | 2/1972 | (GB) . |
| 1465175 | 2/1977 | (GB) . |
| 1465176 | 2/1977 | (GB) . |
| 1468791 | 3/1977 | (GB) . |
| 2121807 | 1/1984 | (GB) . |
| WO 91/11488 | 8/1991 | (WO) . |
| WO 91/16407 | 10/1991 | (WO) . |
| WO 93/04148 | 3/1993 | (WO) . |

OTHER PUBLICATIONS

"Comb–Like Polymers. Structure And Properties", N. A. Plate and V. P. Shibaev, J.Poly.Sci. Macromolecular Revs., 8,p 117 to 253 (1974).

"Industrial Waxes " by H. Bennett published in 1975.

* cited by examiner

*Primary Examiner*—Jacqueline V. Howard

(57) ABSTRACT

A class of waxes improves the low temperature flow properties of oils.

14 Claims, No Drawings

ADDITIVES AND OIL COMPOSITIONS

This invention relates to additives for improving the low temperature properties, particularly flow and/or filterability properties, of oils and to oil compositions exhibiting such improved properties.

Many oils, particularly those derived from petroleum sources or from animal or vegetable oils and fats, are susceptible to the formation of wax at low temperatures. This problem is well known in the art.

In particular, fuel oils, whether derived from petroleum or from animal or vegetable sources, contain components that at low temperature tend to precipitate as large crystals or spherulites of wax in such a way as to form a gel structure which causes the fuel to lose its ability to flow. The lowest temperature at which the oil will still flow is known as the pour point.

As the temperature of fuel oils fall and approach the pour point, difficulties arise in transporting the fuel through lines and pumps. Further, the wax crystals tend to plug fuel lines, screens, and filters at temperatures above the pour point. These fuel problems are well recognised in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an n-alkane wax, crystallises as platelets; certain additives, usually referred to as cold flow improves, inhibit this, causing the wax to adopt an acicular habit, the resulting needles being more likely to pass through a filter than platelets.

A further problem encountered at temperatures low enough for wax to form in a fuel is the settlement of the wax to the lower region of any storage vessel. This has two effects; one in the vessel itself where the settled layer of wax may block an outlet at the lower end, and the second in subsequent use of the fuel. The composition of the wax-rich portion of fuel will differ from that of the remainder, and will have poorer low temperature properties than that of the homogeneous fuel from which it is derived.

There are various additives available which change the nature of the wax formed, so that it remains suspended in the fuel, achieving a dispersion of waxy material throughout the depth of the fuel in the vessel, with a greater or lesser degree of uniformity depending on the effectiveness of the additive on the fuel. Such additives may be referred to as wax anti-settling additives.

Petroleum waxes, i.e. waxes derived from petroleum sources, comprise complex mixtures of hydrocarbons, including normal and branched alkanes and cycloalkanes. A wide variety of petroleum waxes have been produced commercially and such waxes differ in the relative proportions of different hydrocarbon components, a result of differences both in petroleum source materials and in the separation and processing techniques employed to obtain a particular wax. Waxes may, for example, be obtained by dewaxing of wax-containing petroleum distillate fractions, involving physical separation and subsequent fractionation of the separated waxy material into individual waxes suitable for particular applications and having particular properties.

The art describes certain waxes as suitable additives for improving the low temperature properties of fuel oils. EP-A-0 239 320 describes the addition to distillate fuels of n-alkanes in an amount sufficient to raise the amount of $C_{24}$ and above n-alkanes in the resulting composition to above 0.35 wt %, whereby the response of such fuels to conventional low temperature flow improvers is improved. U.S. Pat. No. 4,210,424 describes additive compositions comprising normal paraffinic wax of average molecular weight in the range of 300 to 650. Examples of suitable normal paraffinic waxes include slack wax and slop wax. Such waxes may consist of $C_{20}$ to $C_{45}$ n-alkanes.

GB 1,465,175 and GB 1,468,791 describe the use of microcrystalline waxes having melting points in the range of 145° F. to 190° F. (approximately 63° C. to 88° C.) and number average molecular weights in the range of 490 to 800. Exemplified is a wax of melting point 167° F. (75° C.) and number average molecular weight of 634, containing 22.6% n-paraffins. Such waxes are described as useful for improving the low temperature flowability of petroleum middle distillate fuels in combination with a hydrocarbyl succinamic acid or amine or ammonium salt thereof (GB 1,465,175) or a halogenated homo- or copolymer of ethylene (GB 1,468,791).

GB 1,465,176 describes the use of an essentially saturated, amorphous, normally solid petroleum hydrocarbon fraction having a melting point in the range of 80° F. to 140° F. (approximately 27° C. to 60° C.) and having number average molecular weights in the range of 475 to 600. Exemplified is an amorphous fraction having a melting point of 115° F. (approximately 46° C.), aromatic content of 7.4% and total alkane content of 91.6%, and obtained as a by-product from the dewaxing of a heavy paraffinic crude oil. Such amorphous materials are also described as effective low temperature additives in combination either with halogenated homo- or copolymers of ethylene or with succinamic acids or amine or ammonium salts thereof.

We have now discovered that a certain type of petroleum wax shows excellent performance as a low temperature flow improver additive for oils, and especially fuel oils, as well as being easily handled at normal operating temperatures. Such a wax gives excellent results in combination with a variety of low temperature flow improver additives and improves the effects thereof in a variety of oils.

In a first aspect, this invention provides an additive composition comprising one or more petroleum waxes, characterised in that at least one wax has a melting point in the range of 42° C. to 59° C. and a refractive index in the range of 1.445 to 1.458, measured at 70° C.

In a second aspect, the invention provides an additive concentrate composition comprising the additive composition of the first aspect in admixture with a compatible solvent thereof.

In a third aspect, this invention provides a fuel oil composition comprising fuel oil and a minor proportion either of the composition of the first or second aspect or of at least one petroleum wax having a melting point in the range of 42° C. to 59° C. and a refractive index in the range of 1.445 to 1.458, measured at 70° C.

Other aspects of the invention include the use of the additive of the first aspect or wax defined under the first aspect, or of the concentrate of the second aspect, in a fuel oil to improve the low temperature flow properties thereof; a method for improving same properties of a fuel oil, comprising the addition thereto of the additive, wax or concentrate; an oil refinery or depot containing the additive, wax, concentrate or fuel oil composition; and a fuel oil combustion or transportation system containing the fuel oil composition.

The additive composition (first aspect of the invention).

The additive comprises one or more petroleum waxes having the above-defined melting point and refractive index characteristics.

Waxes have conventionally been defined by reference to their gross physical characteristics, in view of the large and varied number of hydrocarbon components which they contain, and the difficulties in separating such closely-homologous hydrocarbon molecules. "Industrial waxes" by H. Bennett and published in 1975 describes the different types of petroleum wax and indicates that the characteristics of melting point and refractive index have proved useful in classifying the variety of waxes available from different sources. According to this invention, a certain sub-class of waxes—namely those having certain defined ranges of melting point and refractive index are particularly effective for improving the low temperature flow properties of oils, and especially fuel oils such as middle distillate fuel oils. Whilst not wishing to be bound by any particular theory, it is postulated that waxes within this sub-class possess a combination of components which interact very favourably with precipitating n-alkanes present within the oil and with any further low temperature flow improver also present in the oil, such that the detrimental effects of the precipitated wax inherent in the fuel are reduced or even prevented.

The melting point of the waxes useful in the present invention is preferably in the range of 44° C. to 55° C., more preferably 45° C. to 53° C., and most preferably in the range of 47° C. to 53° C. Melting point as defined within this specification refers to that parameter as measured according to standard test method ASTM D938

The refractive index of the waxes useful in the present invention is preferably in the range of 1.445 to 1.455, more preferably in the range of 1.447 to 1.454, and most preferably in the range of 1.445 to 1.453, particularly in the range of 1.445 to 1.453. Refractive index as defined within this specification is that parameter as measured according to test method ASTM D1747-94, wherein the temperature at the point of measurement has been set to 70° C.

Particularly suitable waxes have the following combinations of melting point and refractive index, measured according to the above-defined tests:

(i) a melting point in the range of 42° C. to 59° C. and a refractive index in the range of 1.445 to 1.455;

(ii) preferably a melting point in the range of 44° C. to 55° C. and a refractive index in the range of 1.447 to 1.454;

(iii) more preferably a melting point in the range of 45° C. to 53° C. and a refractive index in the range of 1.445 to 1.453; and (iv) most preferably a melting point in the range of 47° C. to 53° C. and a refractive index in the range of 1.451 to 1.453;

The waxes according to this invention are typically obtained by appropriate separation and fractionation of wax-containing distillate fractions, and are available from wax suppliers.

A single wax having the defined characteristics may be used in the additive composition of the first aspect. However, more than one of the defined waxes, or mixtures of one or more of the defined waxes with one or more other types of wax may be used with advantage.

The sub-class of waxes characterising the additive of the invention show good performance as low temperature flow improvers, and can surprisingly provide better enhancement of flow properties than conventional types of wax used in flow improver applications.

The additive composition may usefully comprise other low temperature flow improver additives effective in the oil composition being treated. For example, where the oil is a fuel oil, such co-additives include other fuel oil cold flow improvers, which may give surprisingly improved performance when combined with the wax.

Such co-additives include the following:

(i) ethylene-unsaturated ester copolymers;

(ii) comb polymers;

(iii) hydrocarbon polymers;

(iv) sulphur carboxy compounds;

(v) polar nitrogen compounds;

(vi) hydrocarboxylated aromatics;

(vii) polyoxyalkylene compounds.

These co-additives are described in more detail below.

(i) Ethylene-unsaturated Ester Copolymers

Ethylene copolymer flow improvers e.g. ethylene unsaturated ester copolymer flow improvers, have a polymethylene backbone divided into segments by hydrocarbyl side chains interrupted by one or more oxygen atoms and/or carbonyl groups.

More especially, the copolymer may comprise an ethylene copolymer having, in addition to units derived from ethylene, units of the formula $$—CR^5R^6—CHR^7—$$

wherein $R^6$ represents hydrogen or a methyl group;

$R^5$ represents a —$OOCR^8$ or -$COOR^8$ group wherein $R^8$ represents hydrogen or a $C_1$ to $C_{28}$, preferably $C_1$ to $C_{16}$, more preferably $C_1$ to $C_9$, straight or branched chain alkyl group; and $R^7$ represents hydrogen or a —$COOR^8$ or —$OOCR^8$ group.

These may comprise a copolymer of ethylene with an ethylenically unsaturated ester, or derivatives thereof. An example is a copolymer of ethylene with an ester of an unsaturated carboxylic acid such as ethylene-acrylates (e.g. ethylene-2-ethylhexylacrylate), but the ester is preferably one of an unsaturated alcohol with a saturated carboxylic acid such as described in GB-A-1,263,152. An ethylene-vinyl ester copolymer is advantageous; an ethylene-vinyl acetate, ethylene vinyl propionate, ethylene-vinyl hexanoate, ethylene 2-ethylhexanoate, or ethylene-vinyl octanoate copolymer or terolymer is preferred. Neo acid vinyl esters are also useful. Preferably, the copolymers contain from 1 to 25 such as less than 25, e.g. 1 to 20, mole % of the vinyl ester, more preferably from 3 to 18 mole % vinyl ester. They may also be in the form of mixtures of two copolymers such as those described in U.S. Pat. No. 3,961,916 and EP-A-113,581. Preferably, number average molecular weight, as measured by vapour phase osmometry, of the copolymer is 1,000 to 10,000, more preferably 1,000 to 5,000. If desired, the copolymers may be derived from additional comonomers, e.g. they may be terpolymers or tetrapolymers or higher polymers, for example where the additional comonomer is isobutylene or diisobutylene or another ester giving rise to different units of the above formula and wherein the above-mentioned mole %'s of ester relate to total ester.

Also, the copolymers may additionally include small proportions of chain transfer agents and/or molecular weight modifiers (e.g. acetaldehyde or propionaldehyde) that may be used in the polymerisation process to make the copolymer.

The copolymers may be made by direct polymerisation of comonomers. Such copolymers may also be made by transesterification, or by hydrolysis and re-esterification, of an ethylene unsaturated ester copolymer to give a different ethylene unsaturated ester copolymer. For example, ethylene vinyl hexanoate and ethylene vinyl octanoate copolymers may be made in this way, e.g. from an ethylene vinyl acetate copolymer. Preferred copolymers are ethylene-vinyl acetate or -vinyl propionate copolymers, or ethylene-vinyl 2-ethyl hexanoate or -octanoate co- or terpolymers, such as ethylene-vinyl acetate-vinyl 2-ethyl hexanoate terpolymers.

The copolymers may, for example, have 15 or fewer, preferably 10 or fewer, more preferably 6 or fewer, most preferably 2 to 5, methyl terminating side branches per 100 methylene groups, as measured by nuclear magnetic resonance spectroscopy, other than methyl groups on a comonomer ester and other than terminal methyl groups.

The copolymers may have a polydispersity of 1 to 6 preferably 2 to 4, polydispersity being the ratio of weight average molecular weight to number average molecular weight both as measured by Gel Permeation Chromatography using polystyrene standards.

(ii) Comb Polymers

Comb polymers are discussed in "Comb-Like Polymers. Structure and Properties", N. A. Platé and V. P. Shibaev, J. Poly. Sci. Macromolecular Revs., 8, p 117 to 253 (1974).

Generally, comb polymers consist of molecules in which long chain branches such as hydrocarbyl branches, optionally interrupted with one or more oxygen atoms and/or carbonyl groups, having from 6 to 30 such as 10 to 30, carbon atoms, are pendant from a polymer backbone, said branches being bonded directly or indirectly to the backbone. Examples of indirect bonding include bonding via interposed atoms or groups, which bonding can include covalent and/or electrovalent bonding such as in a salt. Generally, comb polymers are distinguished by having a minimum molar proportion of units containing such long chain branches.

Advantageously, the comb polymer is a homopolymer having, or a copolymer at least 25 and preferably at least 40, more preferably at least 50, molar per cent of the units of which have, side chains containing at least 6 such as at least 8, and preferably at least 10, atoms, selected from for example carbon, nitrogen and oxygen, in a linear chain or a chain containing a small amount of branching such as a single methyl branch.

As examples of preferred comb polymers there may be mentioned those containing units of the general formula

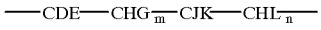

where

D represents $R^{11}$, $COOR^{11}$, $OCOR^{11}$, $R^{12}COOR^{11}$ or $OR^{11}$;

E represents H, D or $R^{12}$;

G represents H or D;

J represents H, $R^{12}$, $R^{12}COOR^{11}$, or a substituted or unsubstituted aryl or heterocyclic group;

K represents H, $COOR^{12}$, $OCOR^{12}$, $OR^{12}$ or COOH;

L represents H, $R^{12}$, $COOR^{12}$, $OCOR^{12}$ or substituted or unsubstituted aryl;

$R^{11}$ representing a hydrocarbyl group having 10 or more carbon atoms, and $R^{12}$ representing a hydrocarbylene (divalent) group in the $^{12}COOR^{11}$ moiety and otherwise a hydrocarbyl (monovalent) group, and m and n represent mole ratios, their sum being 1 and m being finite and being up to and including 1 and n being from zero to less than 1, preferably m being within the range of from 1.0 to 0.4, n being in the range of from 0 to 0.6. $R^{11}$ advantageously represents a hydrocarbyl group with from 10 to 30 carbon atoms, preferably 10 to 24, more preferably 10 to 18. Preferably, $R^{11}$ is a linear or slightly branched alkyl group and $R^{12}$ advantageously represents a hydrocarbyl group with from 1 to 30 carbon atoms when monovalent, preferably with 6 or greater, more preferably 10 or greater, preferably up to 24, more preferably up to 18 carbon atoms. Preferably, $R^{12}$, when monovalent, is a linear or slightly branched alkyl group. When $R^{12}$ is divalent, it is preferably a methylene or ethylene group. By "slightly branched" is meant having a single methyl branch.

The comb polymer may contain units derived from other monomers if desired or required, examples being CO, vinyl acetate and ethylene. It is within the scope of the invention to include two or more different comb copolymers.

The comb polymers may, for example, be copolymers of maleic anhydride or fumaric acid and another ethylenically unsaturated monomer, e.g. an α-olefin or an unsaturated ester, for example, vinyl acetate as described in EP-A-214,786. It is preferred but not essential that equimolar amounts of the comonomers be used although molar proportions in the range of 2 to 1 and 1 to 2 are suitable. Examples of olefins that may be copolymerized with e.g. maleic anhydride, include 1-decene, 1-dodecene, 1-tetradecene, 1-hexadecene, 1-octadecene, and styrene. Other examples of comb polymer include methacrylates and acrylates.

The copolymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol, 2-methyltridecan-1-ol as described in EP-A-213,879. The alcohol may be a mixture of normal and single methyl branched alcohols. It is preferred to use pure alcohols rather than alcohol mixtures such as may be commercially available; if mixtures are used the number of carbon atoms in the alkyl group is taken to be the average number of carbon atoms in the alkyl groups of the alcohol mixture; if alcohols that contain a branch at the 1 or 2 positions are used the number of carbon atoms in the alkyl group is taken to be the number in the straight chain backbone segment of the alkyl group of the alcohol.

The comb polymers may especially be fumarate or itaconate polymers and copolymers such as for example those described in European Patent Applications 153 176, 153 177, 156 577 and 225 688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{12}/C_{14}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{12}$ and $C_{14}$ alcohols. Furthermore, mixtures of the $C_{12}$ ester with the mixed $C_{12}/C_{14}$ ester may advantageously be used. In such mixtures, the ratio of $C_{12}$ to $C_{12}/C_{14}$ is advantageously in the range of from 1:1 to 4:1, preferably 2:1 to 7:2, and most preferably about 3:1, by weight. The particularly preferred fumarate comb polymers may, for example, have a number average molecular weight in the range of 1,000 to 100,000, preferably 1,000 to 50,000, as measured by Vapour Phase Osmometry (VPO).

Other suitable comb polymers are the polymers and copolymers of α-olefins and esterified copolymers of styrene and maleic anhydride, and esterified copolymers of styrene and fumaric acid as described in EP-A-282,342; mixtures of two or more comb polymers may be used in accordance with the invention and, as indicated above, such use may be advantageous.

Other examples of comb polymers are hydrocarbon polymers such as copolymers of ethylene and at least one α-olefin, preferably the α-olefin having at most 20 carbon atoms, examples being n-octene-1, iso octene-1, n-decene-1 and n-dodecene-1, n-tetradecene-1 and n-hexadecene-1 (for example, as described in WO9319106). Preferably, the number average molecular weight measured by Gel Permeation Chromatography against polystyrene standards of such a copolymer is for example, up to 30,000 or up to 40,000. The hydrocarbon copolymers may be prepared by methods known in the art, for example using a Ziegler type catalyst. Such hydrocarbon polymers may for example have an isotacticity of 75% or greater.

(iii) Hydrocarbon Polymers

These have one or more polymethylene backbones, optionally divided into segments by short chain length hydrocarbyl groups, i.e. of 5 or less carbon atoms.

Examples are those represented by the following general formula

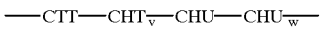

where

T represents H or $R^9$;

U represents H, T or substituted or unsubstituted aryl; and $R^9$ represents a hydrocarbyl group having up to 5 carbon atoms.

and v and w represent mole ratios, v being within the range 1.0 to 0.0, w being within the range 0.0 to 1.0. Preferably, $R^9$ is a straight or branched chain alkyl group.

These polymers may be made directly from ethylenically unsaturated monomers or indirectly by hydrogenating the polymer made from monomers such as isoprene and butadiene.

Preferred hydrocarbon polymers are copolymers of ethylene and at least one α-olefin. Examples of such olefins are propylene, 1-butene, isobutene, and 2, 4, 4-trimethylpent-2-ene. The copolymer may also comprise small amounts, e.g. up to 10% by weight of other copolymerizable monomers, for example olefins other than α-olefins, and non-conjugated dienes. The preferred copolymer is an ethylene-propylene copolymer. It is within the scope of the invention to include two or more different ethylene-α-olefin copolymers of this type.

The number average molecular weight of the ethylene-α-olefin copolymer is less than 150,000, as measured by gel permeation chromatography (GPC) relative to polystyrene standards. For some applications, it is advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000. For other applications, it is below 30,000, preferably below 15,000 such as below 10,000 or below 6,000.

Also, the copolymers may have an isotacticity of 75% or greater.

Advantageously, the copolymer has a molar ethylene content between 50 and 85 per cent. More advantageously, the ethylene content is within the range of from 55 to 80%, and preferably it is in the range from 55 to 75%; more preferably from 60 to 70%, and most preferably 65 to 70%.

Examples of ethylene-α-olefin copolymers are ethylene-propylene copolymers with a molar ethylene content of from 60 to 75% and a number average molecular weight in the range 60,000 to 120,000, especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. Advantageously, the polymers are substantially amorphous, since highly crystalline polymers are relatively insoluble in fuel oil at low temperatures.

Examples of hydrocarbon polymers are described in WO-A-9 111 488.

The hydrocarbon polymer may be an oil-soluble hydrogenated block diene polymer, comprising at least one crystallizable block, obtainable by end-to-end polymerisation of a linear diene, and at least one non-crystallizable block, the non-crystallizable block being obtainable by 1,2-configuration polymerisation of a linear diene, by polymerisation of a branched diene, or by a mixture of such polymerisations.

Advantageously, the block copolymer before hydrogenation comprises units derived from butadiene only, or from butadiene and at least one comonomer of the formula wherein $R^1$ represents a $C_1$ to $C_8$ alkyl group and $R^2$ represents hydrogen or a $C_1$ to $C_8$ alkyl group. Advantageously the total number of carbon atoms in the comonomer is 5 to 8, and the comonomer is advantageously isoprene. Advantageously, the copolymer contains at least 10% by weight of units derived from butadiene.

In general, the crystallizable block or blocks will be the hydrogenation product of the unit resulting from predominantly 1,4- or end-to-end polymerisation of butadiene, while the non-crystallizable block or blocks will be the hydrogenation product of the unit resulting from 1,2-polymerisation of butadiene or from 1,4-polymerisation of an alkyl-substituted butadiene.

(iv) Sulphur Carboxy Compounds

Examples are those described in EP-A-0,261,957 which describes the use of compounds of the general formula

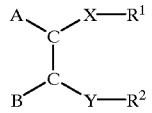

in which

—Y—$R^2$ is $SO_3^{(-)(+)}NR_3^3R^2$, —$SO_3^{(-)(+)}HNR_2^3R^2$, —$SO_3^{(-)(+)}H_2NR^3R^2$, —$SO_3^{(-)(+)}H_3NR^2$, —$SO_2NR^3R^2$ or —$SO_3R^2$;

and —X—$R^1$ is —Y—$R^2$ or —$CONR^3R^1$, —$CO_2^{(-)(+)}NR_3^3R^1$, —$CO_2^{(-)(+)}HNR_2^3R^1$, —$R^4$—$COOR_1$, —$NR^3COR^1$, —$R^4OR^1$, —$R^4OCOR^1$, —$R^4$,$R^1$, —$N(COR^3)R^1$ or $Z^{(-)(+)}NR_3^3R^1$; —$Z^{(-)}$ is $SO_3^{(-)}$ or —$CO_2^{(-)}$;

$R^1$ and $R^2$ are alkyl, alkoxyalkyl or polyalkoxyalkyl containing at least 10 carbon atoms in the main chain;

$R^3$ is hydrocarbyl and each $R^3$ may be the same or different and $R^4$ is absent or is $C_1$ to $C_5$ alkylene and in

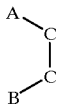

the carbon-carbon (C—C) bond is either a) ethylenically unsaturated when A and B may be alkyl, alkenyl or substituted hydrocarbyl groups or b) part of a cyclic structure which may be aromatic, polynuclear aromatic or cycloaliphatic, it is preferred that X—$R^1$ and Y—$R^2$ between them contain at least three alkyl, alkoxyalkyl or polyalkoxyalkyl groups.

EP-A-0,316,108 describes an amine or diamine salt of (a) a sulphosuccinic acid, b) an ester or diester of a sulphosuccinic acid, c) an amide or a diamide of a sulphosuccinic acid, or d) an ester-amide of a sulphosuccinic acid.

Multicomponent additive systems may be used and the ratios of additives to be used will depend on the fuel to be treated.

(v) Polar Nitrogen Compounds

Such compounds comprise an oil-soluble polar nitrogen compound carrying one or more, preferably two or more, hydrocarbyl substituted amino or imino substituents, the hydrocarbyl group(s) being monovalent and containing 8 to 40 carbon atoms, which substituent or one or more of which substituents optionally being in the form of a cation derived therefrom. The oil-soluble polar nitrogen compound is either ionic or non-ionic and is capable of acting as a wax crystal growth modifier in fuels. Preferably, the hydrocarbyl group is linear or slightly linear, i.e. it may have one short length (1–4 carbon atoms) hydrocarbyl branch. When the substituent is amino, it may carry more than one said hydrocarbyl group, which may be the same or different.

The term "hydrocarbyl" refers to a group having a carbon atom directly attached to the rest of the molecule and having a hydrocarbon or predominantly hydrocarbon character. Examples include hydrocarbon groups, including aliphatic (e.g. alkyl or alkenyl), alicyclic (e.g. cycloalkyl or cycloalkenyl), aromatic, and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred.

Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulphur, and, preferably, oxygen.

More especially, the or each amino or imino substituent is bonded to a moiety via an intermediate linking group such as —CO—, —$CO_2^{(-)}$, —$SO_3^{(-)}$ or hydrocarbylene. Where the linking group is anionic, the substituent is part of a cationic group, as in an amine salt group.

When the polar nitrogen compound carries more than one amino or imino substituent, the linking groups for each substituent may be the same or different.

Suitable amino substituents are long chain $C_{12}$–$C_{40}$, preferably $C_{12}$–$C_{24}$, alkyl primary, secondary, tertiary or quaternary amino substituents.

Preferably, the amino substituent is a dialkylamino substituent, which, as indicated above, may be in the form of an amine salt thereof; tertiary and quaternary amines can form only amine salts. Said alkyl groups may be the same or different.

Examples of amino substituents include dodecylamino, tetradecylamino, cocoamino, and hydrogenated tallow amino. Examples of secondary amino substituents include dioctadecylamino and methylbehenylamino. Mixtures of amino substituents may be present such as those derived from naturally occurring amines. A preferred amino substituent is the secondary hydrogenated tallow amino substituent, the alkyl groups of which are derived from hydrogenated tallow fat and are typically composed of approximately 4% $C_{14}$, 31% $C_{16}$ and 59% $C_{18}$ n-alkyl groups by weight.

Suitable imino substituents are long chain $C_{12}$–$C_{40}$, preferably $C_{12}$–$C_{24}$, alkyl substituents.

Said moiety may be monomeric (cycylic or non-cyclic) or polymeric. When non-cyclic, it may be obtained from a cyclic precursor such as an anhydride or a spirobislactone.

The cyclic ring system may include homocyclic, heterocyclic, or fused polycyclic assemblies, or a system where two or more such cyclic assemblies are joined to one another and in which the cyclic assemblies may be the same or different. Where there are two or more such cyclic assemblies, the substituents may be on the same or different assemblies, preferably on the same assembly. Preferably, the or each cyclic assembly is aromatic, more preferably a benzene ring. Most preferably, the cyclic ring system is a single benzene ring when it is preferred that the substituents are in the ortho or meta positions, which benzene ring may be optionally further substituted.

The ring atoms in the cyclic assembly or assemblies are preferably carbon atoms but may for example include one or more ring N, S or O atom, in which case or cases the compound is a heterocyclic compound.

Examples of such polycyclic assemblies include (a) condensed benzene structures such as naphthalene, anthracene, phenanthrene, and pyrene;

(b) condensed ring structures where none of or not all of the rings are benzene such as azulene, indene, hydroindene, fluorene, and diphenylene oxides:

(c) rings joined "end-on" such as diphenyl;

(d) heterocyclic compounds such as quinoline, indole, 2:3 dihydroindole, benzofuran, coumarin, isocoumarin, benzothiophen, carbazole and thiodiphenylamine;

(e) non-aromatic or partially saturated ring systems such as decalin (i.e. decahydronaphthalene), a-pinene, cardinene, and bornylene; and (f) three-dimensional structures such as norbornene, bicycloheptane (i.e. norbornane), bicyclooctane, and bicyclooctene.

Examples of polar nitrogen compounds are described below:

(i) an amine salt and/or amide of a mono- or polycarboxylic acid, e.g. having 1 to 4 carboxylic acid groups. It may be made, for example, by reacting at least one molar proportion of a hydrocarbyl substituted amine with a molar proportion of the acid or its anhydride.

When an amide is formed, the linking group is —CO—, and when an amine salt is formed, the linking group is —$CO_2^{(-)}$.

The moiety may be cyclic or non-cyclic. Examples of cyclic moieties are those where the acid is cyclohexane 1,2-dicarboxylic acid; cyclohexane 1,2-dicarboxylic acid; cyclopentane 1,2-dicarboxylic acid; and naphthalene dicarboxylic acid. Generally, such acids have 5 to 13 carbon atoms in the cyclic moiety. Preferred such cyclic acids are benzene dicarboxylic acids such as phthalic acid, isophthalic acid, and terephthalic acid, and benzene tetracarboxylic acids such as pyromelletic acid, phthalic acid being particularly preferred. U.S. Pat. No. 4,211,534 and EP-A-272,889 describes polar nitrogen compounds containing such moieties.

Examples of non-cyclic moieties are those when the acid is a long chain alkyl or alkylene substituted dicarboxylic acid such as a succinic acid, as described in U.S. Pat. No. 4,147,520 for example.

Other examples of non-cyclic moieties are those where the acid is a nitrogen-containing acid such as ethylene diamine tetracetic acid and nitrilotriacetic acid.

Further examples are the moieties obtained where a dialkyl spirobislactone is reacted with an amine as described in DE-A 3 926 99.

(ii) WO-A-9304148 describes a chemical compound comprising or including a cyclic ring system, the compound carrying at least two substituents of the general formula (I) below on the ring system $$—A—NR^{13}R^{14} \quad (1)$$

where A is an aliphatic hydrocarbyl group that is optionally interrupted by one or more hetero atoms and that is straight chain or branched, and $R^{13}$ and $R^{14}$ are the same or different and each is independently a hydrocarbyl group containing 9 to 40 carbon atoms optionally interrupted by one or more hetero atoms, the substituents being the same or different and the compound optionally being in the form of a salt thereof.

Preferably, A has from 1 to 20 carbon atoms and is preferably a methylene or polymethylene group.

Each hydrocarbyl group constituting $R^{13}$ and $R^{14}$ in the invention (Formula 1) may for example be an alkyl or alkylene group or a mono- or poly-alkoxyalkyl group. Preferably, each hydrocarbyl group is a straight chain alkyl group. The number of carbon atoms in each hydrocarbyl group is preferably 16 to 40, more preferably 16 to 24.

Also, it is preferred that the cyclic system is substituted with only two substituents of the general formula (I) and that A is a methylene group.

Examples of salts of the chemical compounds are the acetate and the hydrochloride.

The compounds may conveniently be made by reducing the corresponding amide which may be made by reacting a secondary amine with the appropriate acid chloride.

(iii) A condensate of long chain primary or secondary amine with a carboxylic acid-containing polymer.

Specific examples include polymers such as described in GB-A-2,121,807, FR-A-2,592,387 and DE-A-3,941,561; and also esters of telomer acid and alkanoloamines such as described in U.S. Pat. No. 4,639,256; and the reaction product of an amine containing a branched carboxylic acid ester, an epoxide and a monocarboxylic acid polyester such as described in U.S. Pat. No. 4,631,071.

EP-0,283,292 describes amide containing polymers and EP-0,343,981 describes amine-salt containing polymers.

It should be noted that the polar nitrogen compounds may contain other functionality such as ester functionality.

(vi) Hydrocarbylated Aromatics

These material are condensates comprising aromatic and hydrocarbyl parts. The aromatic part is conveniently an aromatic hydrocarbon which may be unsubstituted or substituted with, for example, non-hydrocarbon substituents.

Such aromatic hydrocarbon preferably contains a maximum of three substituent groups and/or two condensed rings, and is preferably naphthalene. The hydrocarbyl part is a hydrogen and carbon containing part connected to the rest of the molecule by a carbon atom. It may be saturated or unsaturated, and straight or branched, and may contain one or more hetero-atoms provided they do not substantially affect the hydrocarbyl nature of the part. Preferably the hydrocarbyl part is an alkyl part, conveniently having more than 8 carbon atoms.

(vii) Polyoxyalkylene Compounds

Examples include polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkylene group in said polyoxyalkylene glycol containing from 1 to 4 carbon atoms, as described in EP-A-61 895 and in U.S. Pat. No. 4,491,455.

The preferred esters, ethers or ester/ethers which may be used may comprise compounds in which one or more groups (such as 2, 3 or 4 groups) of formula $—OR^{25}$ are bonded to a residue E, where E may for example represent A(alkylene)q, where A represents C or N or is absent, q represents an integer from 1 to 4, and the alkylene group has from one to four carbon atoms, A (alkylene)q for example being $N(CH_2CH_2)_3$; $C(CH_2)_4$; or $(CH_2)_2$; and $R^{25}$ may independently be (a) n-alkyl- (b) n-alkyl-CO- (c) n-alkyl-OCO—$(CH_2)$n-

(d) n-alkyl-OCO—$(CH_2)$nCOn being, for example, 1 to 34, the alkyl group being linear and containing from 10 to 30 carbon atoms. For example, they may be represented by the formula $R^{23}OBOR^{24}$, $R^{23}$ and $R^{24}$ each being defined as for $R^{25}$ above, and B representing the polyalkylene segment of the glycol in which the alkylene group has from 1 to 4 carbon atoms, for example, polyoxymethylene, polyoxyethylene or polyoxytrimethylene moiety which is substantially linear; some degree of branching with lower alkyl side chains (such as in polyoxypropylene glycol) may be tolerated but it is preferred that the glycol should be substantially linear.

Suitable glycols generally are substantially linear polyethylene glycols (PEG) and polypropylene glycols (PPG) having a molecular weight of about 100 to 5,000, preferably about 200 to 2,000. Esters are preferred and fatty acids containing from 10 to 30 carbon atoms are useful for reacting with the glycols to form the ester additives, it being preferred to use $C_{18}$ to $C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, when minor amounts of monoethers and monoesters (which are often formed in the manufacturing process) may also be present. In particular, stearic or behenic diesters of polyethylene glycol, polypropylene glycol or polyethylene/polypropylene glycol mixtures are preferred.

Examples of other compounds in this general category are those described in Japanese Patent Publication Nos. 2-51477 and 3-34790, and EP-A-117,108 and EP-A-326,356, and cyclic esterified ethoxylates such as described EP-A-356,256.

Other suitable esters are those obtainable by the reaction of (i) an aliphatic monocarboxylic acid having 10 to 40 carbon atoms, and (ii) an alkoxylated aliphatic monohydric alcohol, wherein the alcohol has greater than 18 carbon atoms prior to alkoxylation and wherein the degree of alkoxylation is 5 to 30 moles of alkylene oxide per mole of alcohol.

The ester may be formed from a single acid reactant (i) and single alcohol reactant (ii), or from mixtures of acids (i) or alcohols (ii) or both. In the latter cases, a mixture of ester products will be formed which may be used without separation if desired, or separated to give discrete products before use.

The degree of alkoxylation of the aliphatic monohydric alcohol is preferably 10 to 25 moles of alkylene oxide per mole of alcohol, more preferably 15 to 25 moles. The alkoxylation is preferably ethoxylation, although propoxylation or butoxylation can also be used successfully. Mixed alkoxylation, for example a mixture of ethylene and propylene oxide units, may also be used.

The acid reactant (i) preferably has 18 to 30 carbon atoms, more preferably 18 to 22 carbon atoms such as 20 or 22 carbon atoms. The acid is preferably a saturated aliphatic acid, more preferably an alkanoic acid. Alkanoic acids of 18 to 30 carbon atoms are particularly useful. n-Alkanoic acids are preferred. Such acids include behenic acid and arachidic acid, with behenic acid being preferred. Where mixtures of acids are used, it is preferred that the average number of carbon atoms in the acid mixture lies in the above-specified ranges and preferably the individual acids within the mixture will not differ by more than 8 (and more preferably 4) carbon numbers.

The alcohol reactant (ii) is preferably derived from an aliphatic monohydric alcohol having no more than 28 carbon atoms, and more preferably no more than 26 (or better, 24) carbon atoms, prior to alkoxylation. The range of 20 to 22 is particularly advantageous for obtaining good wax crystal modification. The aliphatic alcohol is preferably a saturated aliphatic alcohol, especially an alkanol (i.e. alkyl alcohol). Alkanols having 20 to 28 carbon atoms, and particularly 20 to 26, such as 20 to 22 carbon atoms are preferred. n-Alkanols are most preferred, particularly those having 20 to 24 carbon atoms, and preferably 20 to 22 carbon atoms.

Where the alcohol reactant (ii) is a mixture of alcohols, this mixture may comprise a single aliphatic alcohol alkoxylated to varying degrees, or a mixture of aliphatic alcohols alkoxylated to either the same or varying degrees. Where a mixture of aliphatic alcohols is used, the average carbon number prior to alkoxylation should be above 18 and preferably within the preferred ranges recited above. Preferably, the individual alcohols in the mixture should not differ by more than 4 carbon atoms.

The esterification can be conducted by normal techniques known in the art. Thus, for example one mole equivalent of the alkoxylated alcohol is esterified by one mole equivalent of acid by azeotroping in toluene at 110–120° C. in the presence of 1 weight percent of p-toluene sulphonic acid catalyst until esterification is complete, as judged by Infra-Red Spectroscopy and/or reduction of the hydroxyl and acid numbers.

The alkoxylation of the aliphatic alcohol is also conducted by well-known techniques. Thus for example a suitable alcohol is (where necessary) melted at about 70° C. and 1 wt % of potassium ethoxide in ethanol added, the mixture thereafter being stirred and heated to 100° C. under a nitrogen sparge until ethanol ceases to be distilled off, the mixture subsequently being heated to 150° C. to complete formation of the potassium salt. The reactor is then pressurised with alkylene oxide until the mass increases by the desired weight of alkylene oxide (calculated from the desired degree of alkoxylation). The product is finally cooled to 90° C. and the potassium neutralised (e.g. by adding an equivalent of lactic acid).

Compounds wherein the acid (i) is an alkanoic acid and the alkoxylated alcohol (ii) is formed from one mole of a C20 to C28 alkanol and 15 to 25 moles of ethylene oxide have been found to be particularly effective as low temperature flow and filterability improvers, giving excellent wax crystal modification. In such embodiments, the acid (i) is preferably an n-alkanoic acid having 18 to 26, such as 18 to 22 carbon atoms and the alkanol preferably has 20 to 26, more preferably 20 to 22 carbon atoms. Such a combination of structural features has been found to be particularly advantageous in providing improved wax crystal modification.

Preferably, the additive composition of the first aspect comprises one or more ethylene-unsaturated ester copolymers, and more preferably also comprises one or more polyoxyalkylene compounds.

In addition, the additive composition may comprise one or more other conventional co-additives known in the art, such as detergents, antioxidants, corrosion inhibitors, dehazers, demulsifiers, metal deactivators, antifoaming agents, cetane improvers, cosolvents, package compatibilities, and lubricity additives and antistatic additives.

The Additive Concentrate Composition (Second Aspect of the Invention)

The concentrate comprises the additive as defined above in admixture with a compatible solvent therefor.

The additive composition may take the form of a concentrate. Concentrates comprising the additive in admixture with a carrier liquid (e.g. as a solution or a dispersion) are convenient as a means for incorporating the additive into bulk oil such as distillate fuel, which incorporation may be done by methods known in the art. The concentrates may also contain other additives as required and preferably contain from 3 to 75 wt %, more preferably 3 to 60 wt %, most preferably 10 to 50 wt % of the additives preferably in solution in oil. Examples of carrier liquid are organic solvents including hydrocarbon solvents, for example petroleum fractions such as naphtha, kerosene, diesel and heater oil; aromatic hydrocarbons such as aromatic fractions, e.g. those sold under the 'SOLVESSO' tradename; alcohols and/or esters; and paraffinic hydrocarbons such as hexane and pentane and isoparaffins. The carrier liquid must, of course, be selected having regard to its compatibility with the additive and with the oil.

The additives of the invention may be incorporated into bulk oil by other methods such as those known in the art. If co-additives are required, they may be incorporated into the bulk oil at the same time as the additives of the invention or at a different time.

The Fuel Oil Composition (Third Aspect of the Invention)

The fuel oil composition comprises either the additive or concentrate composition defined above, or the wax defined above, in admixture with a major proportion of fuel oil.

The oil may be fuel oil e.g. a hydrocarbon fuel such as a petroleum-based fuel oil for example kerosene or distillate fuel oil, suitably a middle distillate fuel oil, i.e. a fuel oil obtained in refining crude oil as the fraction between the lighter kerosene and jet fuels fraction and the heavier fuel oil fraction. Such distillate fuel oils generally boil within the range of about 100° C. to about 500° C., e.g. 150° to about 400° C., for example, those having a relatively high Final Boiling Point of above 360° C. ASTM-D86 Middle distillates contain a spread of hydrocarbons boiling over a temperature range. They are also characterised by pour, cloud and CFPP points, as well as their initial boiling point (IBP)

and final boiling point (FBP). The fuel oil can comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils, diesel fuels and heating oils being preferred. The diesel fuel or heating oil may be a straight atmospheric distillate, or may contain minor amounts, e.g. up to 35 wt %, of vacuum gas oil or cracked gas oils or both.

Heating oils may be made of a blend of virgin distillate, e.g. gas oil, naphtha, etc. and cracked distillates, e.g. catalytic cycle stock. A representative specification for a diesel fuel includes a minimum flash point of 38° C. and a 90% distillation point between 282 and 380° C. (see ASTM Designations D-396 and D-975).

Also, the fuel oil may be an animal or vegetable oil (i.e. a 'biofuel'), or a mineral oil as described above in combination with one or more animal or vegetable oils.

Biofuels, being fuels from animal or vegetable sources, are obtained from a renewable source. It has been reported that on combustion less carbon dioxide is formed than is formed by the equivalent quantity of petroleum distillate fuel, e.g. diesel fuel, and very little sulphur dioxide is formed. Certain derivatives of vegetable oil, for example rapeseed oil, e.g. those obtained by saponification and re-esterification with a monohydric alcohol, may be used as a substitute for diesel fuel. It has recently been reported that mixtures of a rapeseed ester, for example, rapeseed methyl ester (RME), with petroleum distillate fuels in ratios of, for example, between 1:99 and 10:90 by volume are commercially viable.

Thus, a biofuel is a vegetable or animal oil or both or a derivative thereof.

Vegetable oils are mainly tricylcerides of monocarboxylic acids, e.g. acids containing 10–25 carbon atoms and listed below

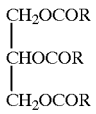

$$\begin{array}{l} CH_2OCOR \\ | \\ CHOCOR \\ | \\ CH_2OCOR \end{array}$$

where R is an aliphatic radical of 10–25 carbon atoms which may be saturated or unsaturated.

Gene rally, such oils contain glycerides of a number of acids, the number and kind varying with the source vegetable of the oil.

Examples of oils are rapeseed oil, coriander oil, soyabean oil, cottonseed oil, sunflower oil, castor oil, olive oil, peanut oil, maize oil, almond oil, palm kernel oil, coconut oil, mustard seed oil, beef tallow and fish oils. Rapeseed oil, which is a mixture of fatty acids partially esterified with glycerol, is preferred as it is available in large quantities and can be obtained in a simple way by pressing from rapeseed.

Examples of derivatives thereof are alkyl esters, such as methyl esters, of fatty acids of the vegetable or animal oils. Such esters can be made by transesterification.

As lower alkyl esters of fatty acids, consideration may be given to the following, for example as commercial mixtures: the ethyl, propyl, butyl and especially methyl esters of fatty acids with 12 to 22 carbon atoms, for example of lauric acid, myristic acid, margaric acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid, which have an iodine number from 50 to 150, especially 90 to 125. Mixtures with particularly advantageous properties are those which contain mainly, i.e. to at least 50 wt % methyl esters of fatty acids with 16 to 22 carbon atoms and 1, 2 or 3 double bonds. The preferred lower alkyl esters of fatty acids are the methyl esters of oleic acid, linoleic acid, linolenic acid and erucic acid.

Commercial mixtures of the stated kind are obtained for example by cleavage and esterification of natural fats and oils by their transesterification with lower aliphatic alcohols. For production of lower alkyl esters of fatty acids it is advantageous to start from fats and oils with high iodine number, such as, for example, sunflower oil, rapeseed oil, coriander oil, castor oil, soyabean oil, cottonseed oil, peanut oil or beef tallow. Lower alkyl esters of fatty acids based on a new variety of rapeseed oil, the fatty acid component of which is derived to more than 80 wt % from unsaturated fatty acids with 18 carbon atoms, are preferred.

The concentration of the additive in the oil may for example be in the range of 1 to 5,000 ppm of additive (active ingredient) by weight per weight of fuel, for example 10 to 5,000 ppm such as 25 to 2500 ppm (active ingredient) by weight per weight of fuel, preferably 50 to 1000 ppm, more preferably 200 to 800 ppm.

The invention will now be further described by way of example only, as follows.

EXAMPLE 1

Studies into the low temperature flow properties of two middle distillate fuel oils were conducted using the cold filter plugging point (CFPP) test protocol, according to international standard method E.N.116.

The fuel oils used had the characteristics displayed in Table 1.

TABLE 1

| Characteristic | Fuel Oil A | Fuel Oil B |
|---|---|---|
| ASTM D-86 Distillation: | | |
| IBP | 180° C. | 171° C. |
| 50% | 285° C. | 289° C. |
| FBP | 358° C. | 349° C. |
| Cloud Point | −6° C. | −5° C. |
| CFPP | −7° C. | −6° C. |
| Density (Kg/dm$^3$) | 0.844 | 0.844 |

Various types of waxes were tested in combination with typical co-additives to determine their efficacy as low temperature flow improvers.

Additives Tested:

Wax A: a wax according to the present invention, having a melting point of 51° C. and a refractive index (at 70° C.) of 1.453.

Wax B: a comparative wax, being a 15ON Slackwax having a melting point of 56° C. and a refractive index of 1.433.

Wax C: a comparative wax, being a petroleum wax (Petrolatum) having a melting point in excess of 70° C.

Co-additive 1: an ethylene vinyl acetate copolymer having a number average molecular weight of 3,500 (by GPC) and containing 16 mole % vinyl acetate.

Co-additive 2: the behenate ester of a $C_{20/22}$ alkanol ethoxylated with 15 ethylene oxide units.

Co-additive 3: the dibehenate ester of a mixture of polyoxyethylene glycols of 200, 400 and 600 number average molecular weights.

Co-additive 4: the amide/amine salt adduct of one molar equivalent of phthalic anhydride and two equivalents molar of dihydrogenated tallow amine.

Co-additive 5: an ethylene-vinyl acetate-vinyl 2-ethylhexanoate terpolymer having a number average molecular weight of 3,500 (GPC).

The combinations and CFPP results are shown in Tables 2 and 3.

TABLE 2

Fuel A

| Treat Rate (ppm, active ingredient) | | | CFPP Results (° C.) with Specified Wax | | |
|---|---|---|---|---|---|
| Co-Additive 1 | Co-Additive 2 | Wax | A | B | C |
| 315 | 35 | 0 | −9 | −9 | −9 |
| 315 | 35 | 175 | −16 | −11 | −16 |
| 315 | 35 | 350 | −19 | −12 | −15 |
| 315 | 35 | 525 | −20 | −19 | −15 |
| 315 | 35 | 700 | −22 | −20 | −19 |
| 360 | 40 | 0 | −13 | −13 | −13 |
| 360 | 40 | 200 | −18 | −15 | −16 |
| 360 | 40 | 400 | −21 | −18 | −19 |
| 360 | 40 | 600 | −23 | −18 | −21 |
| 360 | 40 | 800 | −23 | −19 | −18 |
| SUMMATED CFPP Results (° C.) | | | −184 | −154 | −149 |
| AVERAGE CFPP Results (° C.) | | | −18.4 | −15.4 | −14.9 |

TABLE 3

Fuel B

| Treat Rate (ppm, active ingredient) | | | | | CFPP Results (° C.) with Specified Wax | | |
|---|---|---|---|---|---|---|---|
| Co-Additive 1 | Co-Additive 3 | Co-Additive 4 | Co-Additive 5 | Wax | A | B | C |
| 300 | 300 | 300 | 300 | 0 | −8 | −8 | −8 |
| 300 | 300 | 300 | 300 | 400 | −14 | −10 | −11 |
| 300 | 300 | 300 | 300 | 600 | −21 | −13 | −15 |
| 300 | 300 | 300 | 300 | 800 | −24 | −17 | −21 |
| 300 | 300 | 300 | 300 | 1200 | −25 | −21 | −16 |
| SUMMATED CFPP Results (° C.) | | | | | 92 | 69 | 71 |
| AVERAGE CFPP Results (° C.) | | | | | −18.4 | −13.8 | −14.2 |

As seen from the results, tests involving wax A showed improved performance.

EXAMPLE 2

A variety of waxes were tested in the same fuels and with the same co-additives as described in Example 1. For each wax, the summated CFPP results obtained in each fuel and the overall total are shown in Table 4, and compared with those results obtained for waxes A and C in Example 1.

TABLE 4

| Wax | Refractive Index at 70° C. | Melting Point (° C.) | SUMMATED CFPP Results (° C.) Fuel A | Fuel B | TOTAL SUMMATED CFPP (° C.) |
|---|---|---|---|---|---|
| A | 1.453 | 51 | −184 | −92 | −276 |
| D | 1.451 | 50 | −175 | −86 | −261 |
| E | 1.452 | 47 | −175 | −87 | −262 |
| F | 1.455 | 50 | −155 | −73 | −228 |
| G | 1.453 | 59 | −157 | −75 | −232 |
| B | 1.433 | 56 | −154 | −69 | −223 |
| H | 1.444 | 60 | −158 | −57 | −215 |

TABLE 4-continued

| Wax | Refractive Index at 70° C. | Melting Point (° C.) | SUMMATED CFPP Results (° C.) Fuel A | Fuel B | TOTAL SUMMATED CFPP (° C.) |
|---|---|---|---|---|---|
| I | 1.448 | 71 | −143 | −60 | −203 |
| J | 1.448 | 40 | −130 | −51 | −181 |

As can be seen, the waxes of the invention gave lower overall CFPP temperatures than comparative waxes B, H, I and J, indicating higher performance as low temperature flow improvers.

What is claimed is:

1. A fuel oil composition comprising fuel oil and a minor proportion of one or more petroleum waxes, characterized in that at least one wax has a melting point in the range of 42° C. to 59° C. and a refractive index in the range of 1.445 to 1.458, measured at 70° C.

2. The fuel oil composition of claim 1 which comprises one wax.

3. The fuel oil composition of claim 1, wherein at least one wax has a melting point in the range of 44° C. to 55° C. and a refractive index in the range of 1.447 to 1.454, measured at 70° C.

4. The fuel oil composition of claim 3 wherein at least one wax has a melting point in the range of 45° C. to 53° C. and a refractive index in the range of 1.445 to 1.453, measured at 70° C.

5. The fuel oil composition of claim 4 wherein at least one wax has a melting point of 47° C. to 53° C. and a refractive index of 1.451 to 1.453, measured at 70° C.

6. The composition of claim 1 which comprises one or more ethylene-unsaturated ester copolymers.

7. The composition of claim 6 which additionally comprises one or more polyoxyalkylene compounds.

8. A method for improving the low temperature flow properties of a fuel oil, comprising adding to the fuel oil one or more petroleum waxes, characterized in that at least one wax has a melting point in the range of 42° C. to 59° C. and a refractive index in the range of 1.445 to 1.458, measured at 70° C.

9. The method according to claim 8 wherein at least one wax has a melting point in the range of 44° C. to 55° C. and a refractive index in the range of 1.447 to 1.454, measured at 70° C.

10. The method according to claim 8 wherein at least one wax has a melting point in the range of 45° C. to 53° C. and a refractive index in the range of 1.445 to 1.453, measured at 70° C.

11. The method according to claim 8 wherein at least one wax has a melting point of 47° C. to 53° C. and a refractive index of 1.451 to 1.453, measured at 70° C.

12. The method according to claim 8 wherein one or more other low temperature flow improver additives are also added to the fuel oil.

13. A method according to claim 12 which comprises adding to the fuel oil one or more ethylene-unsaturated ester copolymers.

14. A method according to claim 13 which comprises adding to the fuel oil one or more polyoxyalkylene compounds.

* * * * *